US006786641B2

(12) United States Patent
Plourde

(10) Patent No.: US 6,786,641 B2
(45) Date of Patent: Sep. 7, 2004

(54) ASSEMBLY HAVING SLIDER MOUNTED INSIDE ZIPPER FOR RECLOSABLE PACKAGING

(75) Inventor: Eric Paul Plourde, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 117 days.

(21) Appl. No.: 10/175,188

(22) Filed: Jun. 19, 2002

(65) Prior Publication Data

US 2003/0235351 A1 Dec. 25, 2003

(51) Int. Cl.[7] ..... B65D 33/16

(52) U.S. Cl. ..... 383/64; 383/61.2; 383/203; 24/400; 24/415

(58) Field of Search ..... 363/64, 61.2, 203, 363/204, 63; 24/399, 400, 415, 437

(56) References Cited

U.S. PATENT DOCUMENTS

| | | | | | |
|---|---|---|---|---|---|
| 1,734,479 | A | * | 11/1929 | Glidden | 24/437 |
| 2,141,900 | A | * | 12/1938 | Brown | 24/400 |
| 2,358,653 | A | * | 9/1944 | Mock | 383/64 |
| 2,581,604 | A | * | 1/1952 | Roehrl | 24/400 |
| 2,696,032 | A | * | 12/1954 | Sander | 24/400 |
| 2,997,765 | A | * | 8/1961 | Markoff-Moghadam | 24/400 |
| 3,054,434 | A | | 9/1962 | Ausnit et al. | |
| 3,213,505 | A | | 10/1965 | Ausnit et al. | |
| 3,266,112 | A | * | 8/1966 | Heckman | 24/400 |
| 3,426,396 | A | * | 2/1969 | Laguerre | 24/427 |
| 3,634,913 | A | * | 1/1972 | Ausnit | 24/400 |
| 4,260,116 | A | * | 4/1981 | Collin | 242/417.3 |
| 4,637,060 | A | * | 1/1987 | Ausnit | 383/37 |
| 5,059,456 | A | | 10/1991 | Larson et al. | |
| 5,636,415 | A | * | 6/1997 | James | 24/399 |
| 6,305,844 | B1 | * | 10/2001 | Bois | 383/64 |

* cited by examiner

*Primary Examiner*—Jes F. Pascua
(74) *Attorney, Agent, or Firm*—Ostrager Chong; Flaherty & Broitman P.C.

(57) ABSTRACT

A slider-zipper assembly for reclosable packaging in which the slider is mounted inside the zipper. Each zipper part comprises a base and a closure element connected to the base, the respective closure elements being mutually engageable. The slider comprises a body having one end where the zipper is open and another end where the zipper is closed, a first direction being directed from the closed end to the open end and a second direction being opposite to the first direction. A pair of camming surfaces on the slider have respective fixed positional relationships to the body and are divergent in the first direction. These camming surfaces are disposed so that the zipper parts are respectively cammed toward each other as the slider is moved in the first direction and cammed away from each other as the slider is moved in the second direction. No part of the slider confronts the exterior surfaces of the bases of the zipper parts.

28 Claims, 6 Drawing Sheets

ASSEMBLY HAVING SLIDER MOUNTED INSIDE ZIPPER FOR RECLOSABLE PACKAGING

BACKGROUND OF THE INVENTION

This invention generally relates to slider-operated flexible zippers for use in reclosable pouches, bags or other packages of the type in which perishable material, such as foodstuff, may be stored.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 5,809,621 discloses a slider-operated zipper assembly wherein one zipper profile has a pair of handles that cooperate with the slider. As the slider is moved in an opening direction, the handles are squeezed together to disengage the profiles. In U.S. Pat. No. 5,442,838, a slider-operated zipper assembly is disclosed wherein the zipper profiles are engaged and disengaged in the course of a "rolling action". This "rolling action" is described as being achieved through cooperation between flanges on the profiles and shoulders which project inwardly from the arms of the slider.

There is a need for a slider-zipper assembly design that would allow packaging film to be sealed directly to the exterior of the zipper parts without interfering with the operation of the slider. There is a further need for a slider-zipper assembly design that lends itself well to being sealed into the center fold of a packaging film.

BRIEF DESCRIPTION OF THE INVENTION

The invention is directed to a slider-zipper assembly for reclosable packaging in which the slider is mounted inside the zipper. Slider-zipper assembly designs are disclosed that allow packaging film to be sealed directly to the exterior of the zipper parts without interfering with the operation of the slider. Being able to seal the packaging film to the outside of the zipper parts makes it easier to incorporate header features that are typically used to provide evidence of tampering. Conventional extension flanges are not needed when the packaging film is joined to the backs of the zipper profiles. The disclosed designs also facilitate placement and sealing of the slider-zipper assembly in the center fold of a packaging film.

One aspect of the invention is a package comprising front and rear walls joined to first and second parts of a flexible zipper operated by a slider of the type described hereinafter. Each zipper part comprises a base and a closure element connected to the base, the respective closure elements being mutually engageable. The slider comprises a body having one end where the zipper is open and another end where the zipper is closed, a first direction being directed from the closed end to the open end and a second direction being opposite to the first direction. The slider further comprises a pair of camming surfaces that have respective fixed positional relationships to the body and are divergent in the first direction. These camming surfaces are disposed so that the zipper parts are respectively cammed toward each other as the slider is moved in the first direction. No part of the slider confronts the exterior surfaces of the bases of the zipper parts.

Another aspect of the invention is a slider-zipper assembly wherein the slider and the zipper have structures as described in the preceding paragraph.

Another aspect of the invention is a package comprising first and second walls, a zipper comprising first and second zipper parts respectively joined to the first and second walls, and a slider mounted to the zipper. The first zipper part comprises a first base and a first closure element connected to the first base; the second zipper part comprises a second base and a second closure element connected to the second base and engageable with the first closure element. The first base comprises a first groove that opens on an interior surface of the first base; the second base comprises a second groove that opens on an interior surface of the second base. The slider comprises a body and first and second ribs connected to and projecting out of opposing sides of the body, the first rib being engaged in and slidable along the first groove, and the second rib being engaged in and slidable along the second groove.

A further aspect of the invention is a slider comprising a body having first and second ends and first and second sides, a first rib projecting outward from the first side of the body and a second rib projecting outward from the second side of the body, the first and second ribs being generally co-planar and non-parallel.

Another aspect of the invention is a slider comprising a body having first and second ends and first and second sides, a first groove formed in the first side of the body and opening on an exterior surface of the first side, and a second groove formed in the second side of the body and opening on an exterior surface of the second side, the first and second grooves being generally co-planar and non-parallel.

Yet another aspect of the invention is a package comprising a folded sheet of film sealed on three sides to form an enclosed receptacle, a zipper comprising first and second zipper parts sealed to first and second opposing portions of the sheet of film in proximity to the fold in the sheet. A slider is mounted to the zipper. The first zipper part comprises a first base strip having an exterior side sealed to the first opposing portion of the sheet of film and having a first closure element connected to and projecting from an interior side of the first base strip. The second zipper part comprises a second base strip having an exterior side sealed to the second opposing portion of the sheet of film and having a second closure element connected to and projecting from an interior side of the second base strip. The second closure element is engageable with the first closure element when the slider is moved in one direction and is disengageable when the slider is moved in the opposite direction.

A further aspect of the invention is a package comprising a receptacle with a zippered mouth and a slider mounted in the zippered mouth. The zippered mouth comprises first and second ribs projecting inward from opposing sections of the zippered mouth. The slider comprises a body having first and second ends and first and second sides, a first groove formed in the first side of the body and opening on an exterior surface of the first side, and a second groove formed in the second side of the body and opening on an exterior surface of the second side, the first and second grooves being generally coplanar and non-parallel. The first groove engages the first rib and the second groove engages the second rib.

A further aspect of the invention is an assembly comprising first and second zipper parts and a slider mounted to these zipper parts, the first zipper part comprising a first closure element and the second zipper part comprising a second closure element, these closure elements being mutually engageable, wherein the slider separates the zipper parts when moved in an opening direction and closes them when moved in a closing direction, the slider being positioned entirely within the zipper parts.

Another aspect of the invention is a package comprising a web of film folded to form a header and sealed along three unfolded sides; and a slider-operated zipper disposed in proximity to the fold inside said header, the zipper comprising first and second bases sealed to the film, wherein the slider is positioned entirely within the zipper bases.

Other aspects of the invention are disclosed and claimed below.

BRIEF DESCRIPTION OF THE DRAWINGS

FIG. 2 shows a section taken in a plane that is coplanar with the closing end of the slider; FIG. 3 shows a section taken in a plane that is coplanar with the opening end of the slider. [To facilitate the reader's understanding, structure that would ordinarily be visible behind the plane of sectioning has not been shown. This is also true for FIGS. 7–11. Also, although the view in FIG. 3 is opposite to the view seen in FIG. 2, the positions of the male and female profiles have not been reversed for ease in comparison of these figures.]

DETAILED DESCRIPTION OF THE INVENTION

Figure 1:
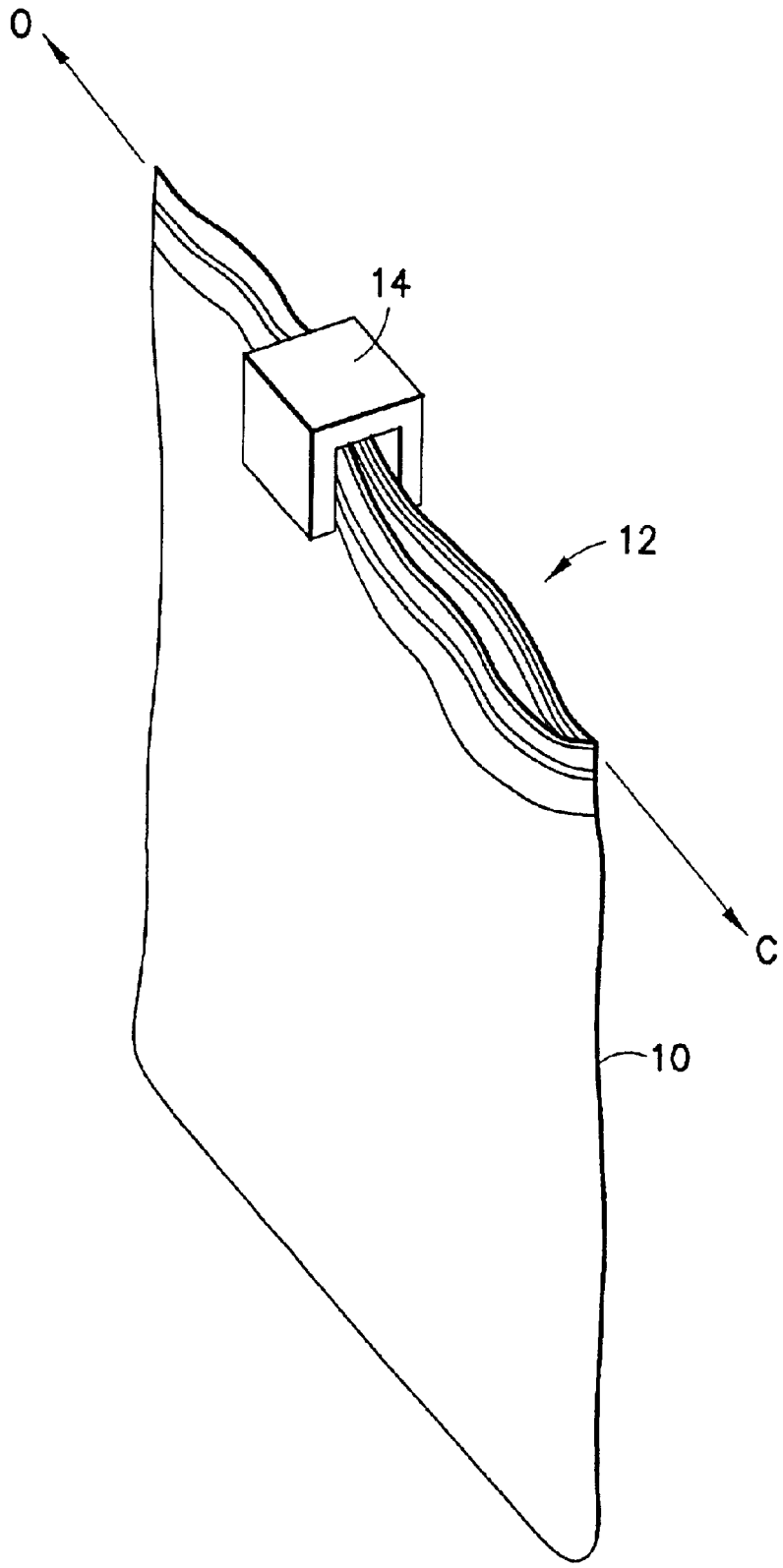
FIG. 1 PRIOR ART
FIG. 1 is a schematic showing an isometric view of a typical reclosable package having a slider-operated flexible zipper.

Reference will now be made to the drawings, in which similar elements in different drawings bear the same reference numerals. A conventional reclosable bag 10 having a flexible plastic zipper 12 operated by manipulation of a slider 14 is shown in FIG. 1. The bag 10 may be made from any suitable sheet material or plastic film and comprises opposite wall panels, which may be secured together at opposite side edges of the bag by seams (not shown). The opposing bottoms of the wall panels may be joined, for example, by means of a heat seal made in conventional fashion, e.g., by application of heat and pressure or ultrasonic energy. Typically, however, the bottom of the package is formed by a fold in the original packaging film.

Optionally, the bag may be provided with side gussets having respective junctures with the front and rear wall panels. In the latter case, the bag may also be provided with a bottom panel having respective junctures with the front and rear wall panels and with the side gussets.

At its top end, the bag 10 has an openable mouth, on the inside of which is an extruded plastic zipper 12. The zipper 12 comprises a pair of interlockable fastener strips or zipper halves. The profiles of the zipper halves may take any form. For example, the zipper may comprise interlocking rib and groove elements or alternating hook-shaped closure elements. The preferred zipper material is polyethylene.

The front and rear bag wall panels are respectively sealed to the zipper halves by heat fusion or welding. Alternatively, the interlockable zipper halves can be attached to the wall panels by adhesive or bonding strips or the zipper profiles can be extruded integrally with the bag material. For the purpose of joinder, each zipper half may be provided with a respective extension flange, to which an upper portion of the respective bag wall panel is fused or welded. The walls of the bag may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

In zippered bags with sliders, as the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The slider of the type shown in FIG. 1 is generally shaped so that the slider straddles the zipper profiles. The ends of the slider are open to allow the zipper to pass through. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

A bag incorporating a zipper and a slider preferably includes means, such as end stops (not shown in FIG. 1), for preventing the slider from sliding off the end of the zipper when the slider reaches the closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops may, for example, comprise stomped areas on the zipper profiles themselves, riveted end clamps, plastic end clips fused to the zipper, or any other suitable structure. The stomped end stops can be sections of the profiles that are fused together proximate to the open and closed slider positions such that the end stops are raised. Stomping can be carried out by, for example, applying heat and/or pressure or using ultrasonic methods.

The zipper halves may comprise interlocking rib and groove elements, which are well known in the art. Many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements. The rib and groove elements may be carefully formed of a soft flexible material in part thereof so that the contents of the package are in fact relatively hermetically sealed from the outside. Alternatively, the zipper halves may comprise interlocking hooks on both halves.

Figure 3:
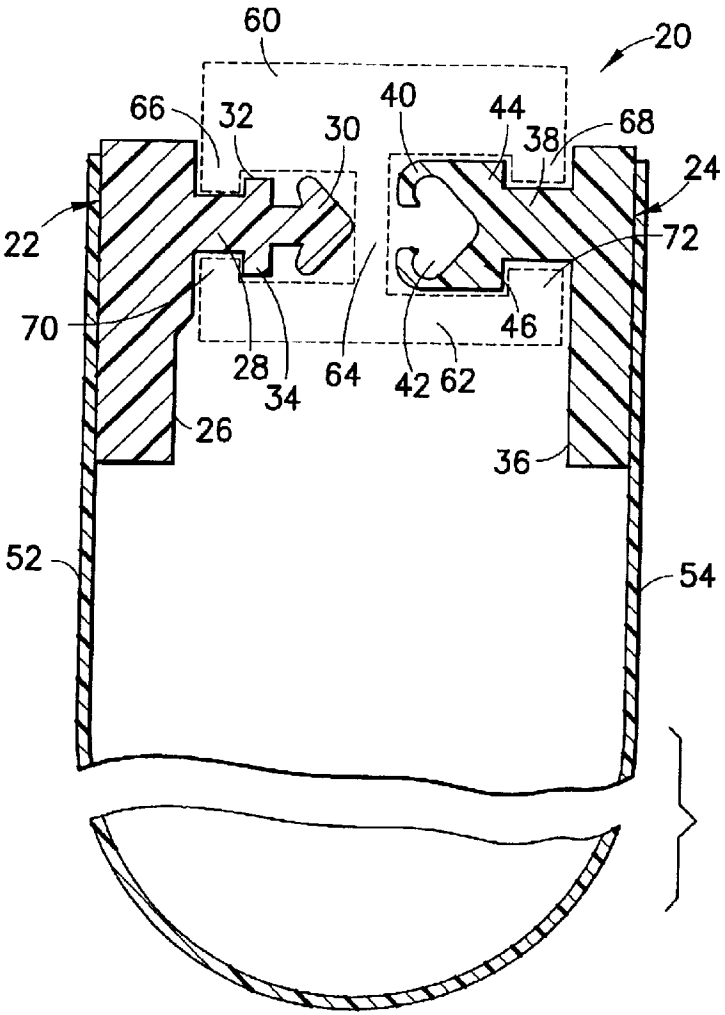
FIGS. 2 and 3 are schematics showing sectional views of a zippered package comprising a slider-zipper assembly in accordance with one embodiment of the invention.
Figure 2:
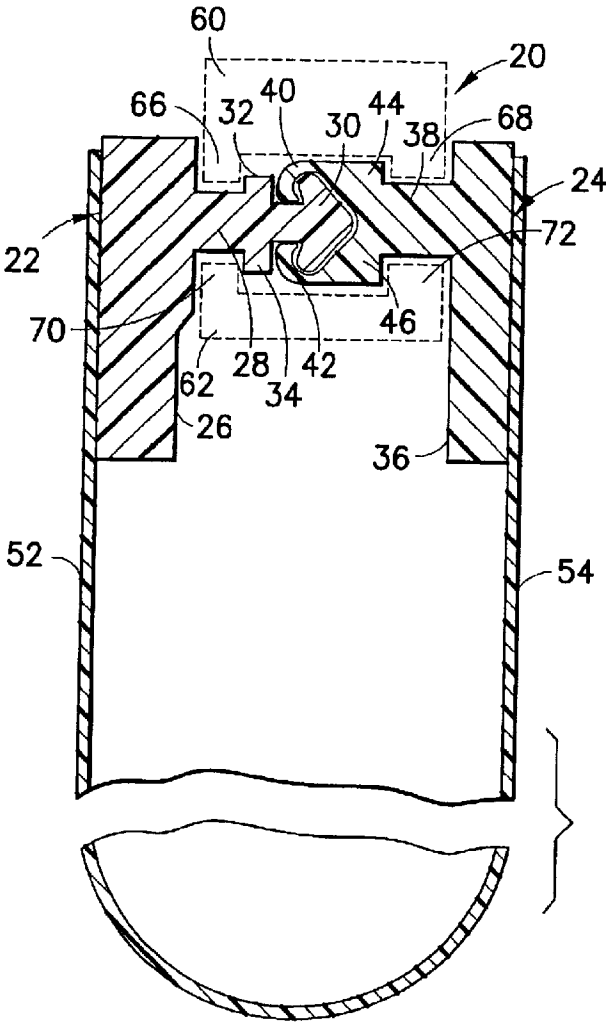

FIGS. 2 and 3 show cross-sectional views of a reclosable package having a slider-zipper assembly in accordance with one embodiment of the present invention. The closing end of a slider 20 is indicated by dashed lines in FIG. 2; the opening end of the slider 20 is indicated by dashed lines in FIG. 3. The zipper is shown in FIG. 2 in a closed state with zipper halves interlocked; the zipper is shown in FIG. 3 in an opened state with the zipper halves disengaged. The zipper comprises first and second fastener strips or zipper parts 22 and 24. Each zipper part is preferably made by extruding thermoplastic material to form a strip with a constant profile. In the disclosed embodiment, rib and groove, i.e., male and female, profiles are shown. However, the zipper opening/closing means disclosed herein are not limited in their application to rib-and-groove type zippers.

The first zipper part 22 comprises a base 26 and a closure element comprising a stem 28 connected to the base 26, an arrow-shaped head 30 connected to a distal portion of the stem 28, an upper projection 32 connected to one side of an intermediate portion of the stem 28, and a lower projection 34 connected to the other side of the stem intermediate portion. An upper section of a rear bag wall panel 52 is joined to the exterior surface of the base 26 by any conventional means.

The second zipper part 24 comprises a base 36 and a closure element comprising a stem 38 connected to the base 36, first and second mutually opposing hooks 40 and 42 connected to a distal portion of stem 38 to form a female profile that engages the enlarged head 30 when the zipper is closed, a first shoulder 44 formed in an area where the first hook 40 connects to the stem 38, and a second shoulder 46 formed in an area where the second hook 42 connects to the stem 38. An upper section of a front bag wall panel 54 is joined to the exterior surface of the base 26 by any conventional means. The front and rear bag wall panels 52 and 54 may be connected at the bag bottom by a fold, as shown in FIG. 2, or by a lap seal, a bottom panel, or a gusset (not shown), or by any other conventional bag structure.

Figure 5:
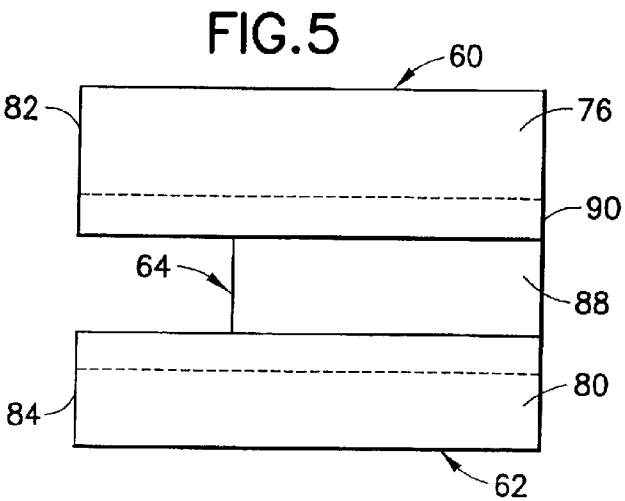
FIGS. 4–6 are schematics showing front, side and top views, respectively, of the slider incorporated in the package depicted in FIGS. 2 and 3.
Figure 6:
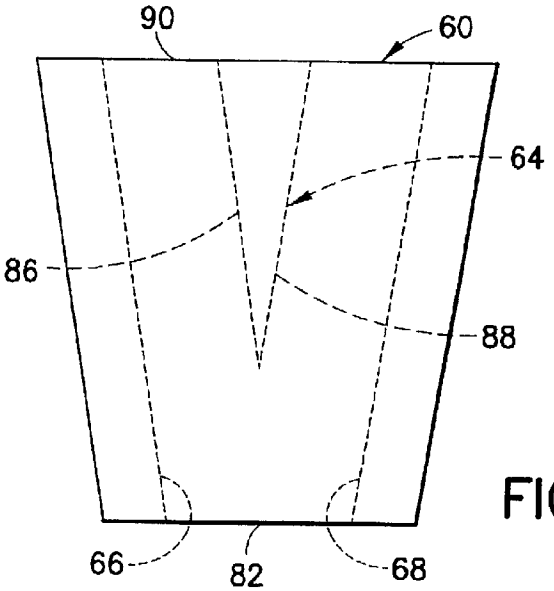
Figure 4:
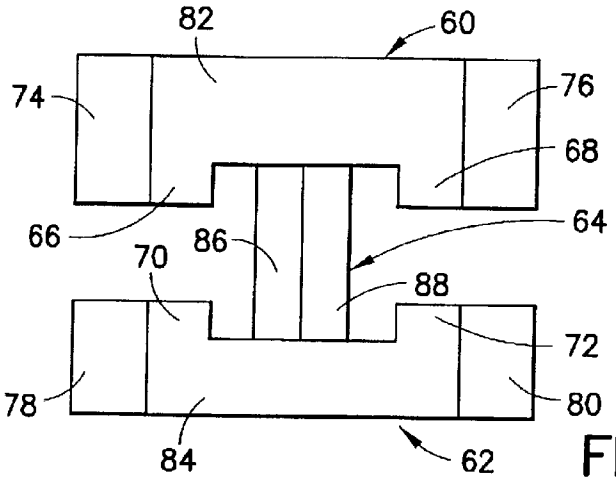

Opening and closing of the zipper is performed by manipulation of slider 20. The sliders of the embodiments disclosed herein are designed to cause the zipper parts 22 and 24 to separate in a horizontal plane, the vertical direction being perpendicular to the top of the slider depicted in FIGS. 2 and 3. That slider 20 (indicated by dashed lines in FIGS. 2 and 3) is shown in more detail in FIGS. 4–6. The slider comprises an upper body part 60 and a lower body part 62 connected only by a wedge-shaped partition 64 (best seen in FIG. 4) that acts as a separating finger or plow to pry the interlocked zipper profiles apart. As best seen in FIG. 6, the partition 64 is a wedge having first and second planar surfaces 86 and 88 that meet at an acute angle. The apex of the wedge lies along a vertical axis. Alternatively, the meeting of surfaces 86 and 88 can be formed by a curved surface rather than an acute angle.

As seen in FIG. 6, the slider has a trapezoidal shape when viewed from above. The sides of the trapezoid are respectively formed by the side faces 74 and 76 of the upper body part 60 and the side faces 78 and 80 of the lower body part 62. The small base of the trapezoid is formed by a front planar face 82 of the upper body part 60 and a front planar face 84 of the lower body part 62, faces 82 and 84 being coplanar. The rear face 90 of the slider 20 includes the coplanar rear faces of the upper and lower body parts 60, 62 and the partition 64.

The slider 20 further comprises a pair of linear projections 66 and 68 projecting downward from the upper body part 60 and an opposing pair of linear projections 70 and 72 projecting upward from the lower body part 62. These projections each have a profile that does not vary along its length. As best seen in FIG. 6, projections 66 and 68 are divergent in a direction from face 82 of the upper body part 60 to the face 90. Projection 70 on the lower body part 62 runs parallel to projection 66 on the upper body part 60, while projection 72 runs parallel to projection 68. In addition, wall 86 of the partition 64 is disposed parallel to projections 66 and 70, while wall 88 of the partition is disposed parallel to projections 68 and 72. The projections 66 and 68 and the upper section of the V-shaped partition 64 form intersecting channels in the upper body part 60. Similar intersecting channels are formed in the lower body part 62 by the projections 70 and 72 and the lower section of the partition 64. As best seen in FIG. 3, the opposing channels on the left-hand side capture the male closure element, while the opposing channels on the right-hand side capture the female closure element. As the closure elements travel along the diverging pairs of opposing channels during slider movement in the opening direction, the channel walls cause the closure elements to separate or disengage from each other, as seen in FIG. 3. Conversely, when the slider is moved in the opposite direction, the channels cause the closure elements to converge into engagement, as seen in FIG. 2. More specifically, the wedge-shaped partition 64 pries apart the head 30 of the male closure element and the hooks 40, 42 of the female closure element during opening, whereas the inner side faces of the projections 66 and 70 push against the opposing side surfaces of the projections 32 and 34 on the stem 28 of the male closure element, while the inner side faces of the projections 68 and 72 push against the opposing surfaces of the shoulders 44 and 46 on the female closure element during closing. In effect, the diverging inner side surfaces of the projections 66, 68, 70 and 72 act as camming means to cam the zipper parts toward each other during slider movement in the closing direction.

Alternatively, instead of the partition 64 being configured to force open the zipper with its leading edge, the diverging outer side surfaces of the projections 66, 68, 70 and 72 can be configured to act as camming means to cam the zipper parts away from each other during slider movement in the opening direction. These outer side surfaces of the projections form part of the slider side faces and would impinge upon the opposing interior surface portions of the base strips located above and/or below the closure elements.

Figure 14:
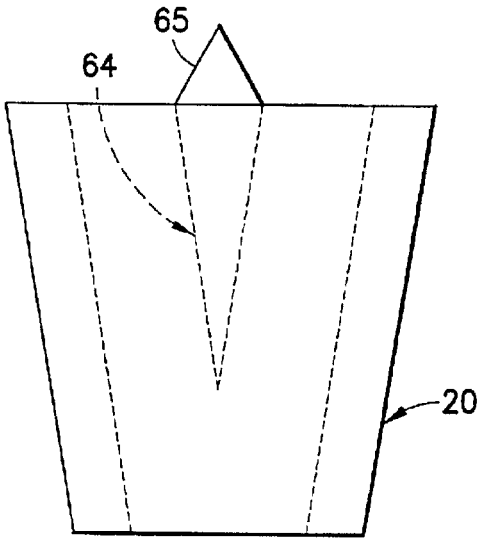
FIG. 14 is a schematic showing a top view of a variant of the slider depicted in FIG. 6.

To minimize the size of any opening remaining in the zipper between the slider and the edge of the bag mouth when the slider is in the fully closed position, the slider 20 shown in FIG. 6 may be modified as seen in FIG. 14. A triangular wedge 65, formed at the rear of the partition 64, can be designed to approximate the gap that is typically left between the opening end of the slider and the edge of the bag mouth. Alternatively, the rear portion of the partition 64 seen in FIG. 6 could be formed as a triangular wedge that is inverted (i.e., pointed in the opposite direction) relative to the main wedge of the partition.

Figure 8:
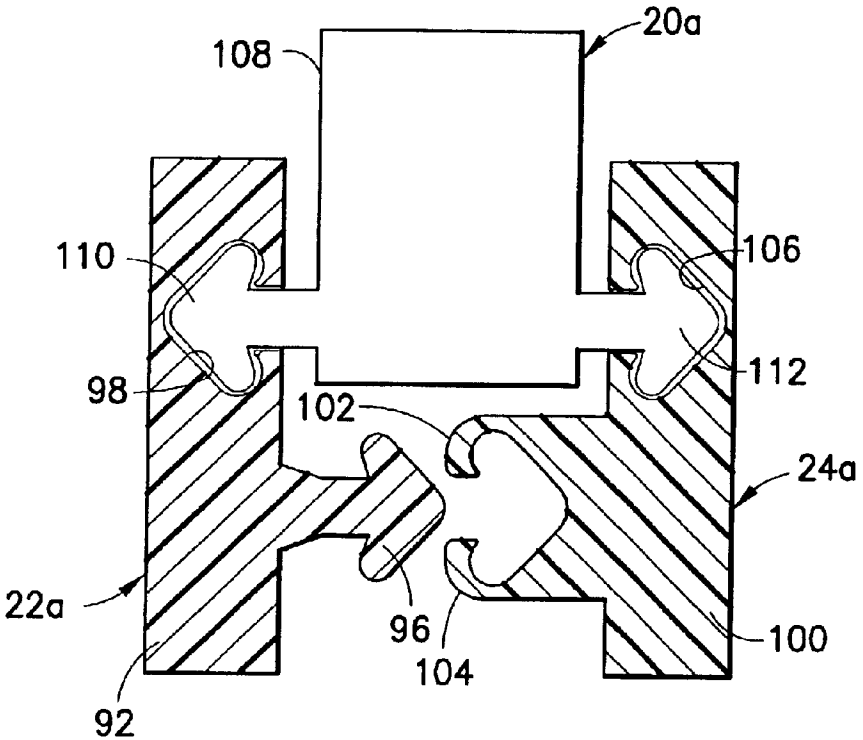
FIGS. 7 and 8 are schematics showing sectional views (from opposite ends of the slider) of a slider-zipper assembly in accordance with another embodiment of the invention. Again, the positions of the male and female profiles have not been reversed for ease in comparison of these figures.
Figure 7:
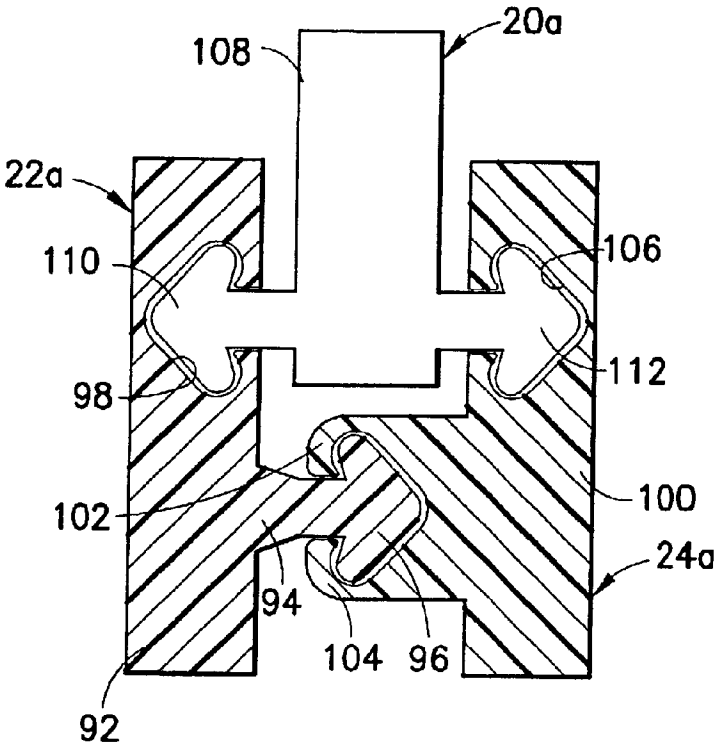

FIGS. 7 and 8 depict a slider-zipper assembly in accordance with another embodiment of the invention. FIG. 7 shows a closed section of zipper and the closing end of the slider; FIG. 8 shows an open section of zipper and the opening end of the slider. In this embodiment, zipper parts 22*a* and 24*a* are opened or closed by movement of a slider 20*a*. The first zipper part 22*a* comprises a base 92 and a closure element comprising a stem 94 connected to the base 92 and an arrow-shaped head 96 connected to a distal portion of the stem 94. The base 92 has a longitudinal groove 98 formed therein that opens on the interior surface of the base 92. The second zipper part 24*a* comprises a base 100 and a closure element comprising first and second mutually opposing hooks 102 and 104 connected to the base 100 to form a female profile that engages the enlarged head 96 when the zipper is closed. The base 100 has a longitudinal groove 106 formed therein that opens on the interior surface of the base 100. Although not shown in FIGS. 7 and 8, it should be understood that upper sections of front and rear walls of a bag can be joined to the exterior surfaces of the bases 92 and 100 by any conventional means.

In accordance with the embodiment depicted in FIGS. 7 and 8, the slider 20*a* comprises a body 108 having a closing end as seen in FIG. 7, an opening end as seen in FIG. 8, and respective sides, a first rib 110 projecting from one side of body 108 and a second rib 112 projecting from the other side of body. Each rib comprises an enlarged head connected to a stem, the tip of the head being substantially linear and divergent in a horizontal plane in a direction from the closing end (seen in FIG. 7) to the opening end (seen in FIG. 8). In other words, the transverse distance separating the tips of ribs 110 and 112 increases substantially linearly in the same direction towards the opening end of the slider. The grooves 98, 106 in the zipper bases 92, 100 each have a groove-shaped profile for receiving a respective rib 110, 112 projecting outwardly from the side walls of the slider 20*a*. Each of ribs 110 and 112 has a pair of detents projecting generally transverse to the stem at the stem's distal portion. The detents, in cooperation with the form-fitting profiled grooves 98, 106, serve to latch the zipper halves 22*a*, 24*a* to the opposing side walls of the slider 20*a*. As the slider is moved in the closing direction, the ribs 110 and 112 cam the zipper parts inward so that the closure elements engage; as the slider is moved in the opening direction, the ribs 110 and 112 cam the zipper parts outward so that the closure elements disengage.

Figure 9:
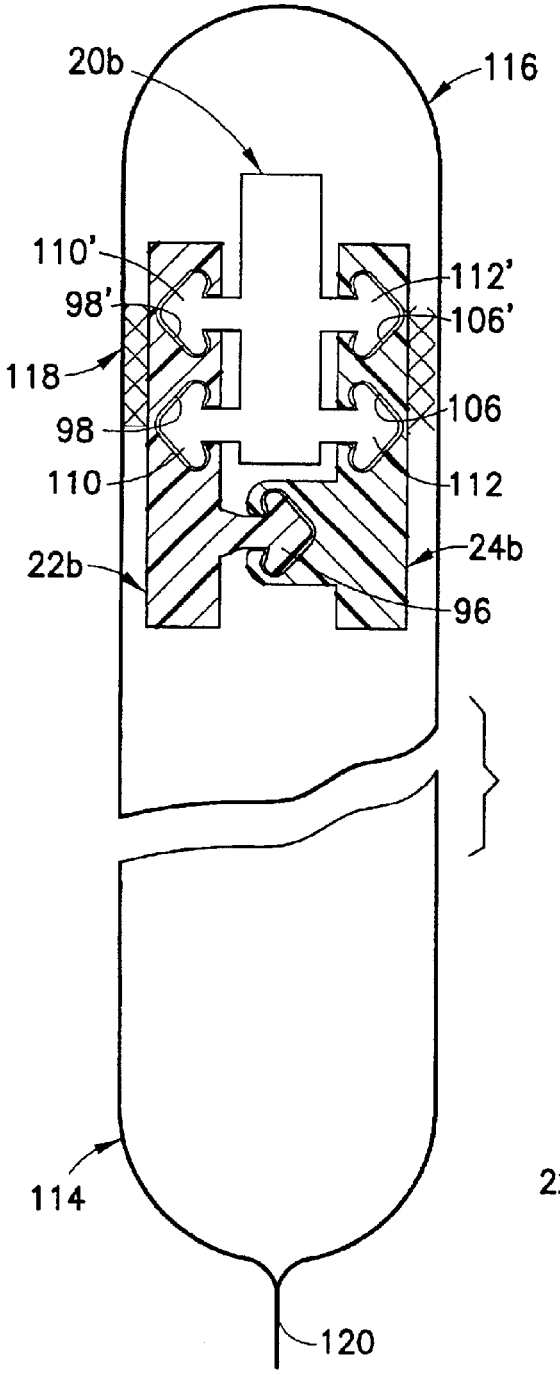
FIG. 9 is a schematic showing a sectional view of a zippered package with a header comprising a slider-zipper assembly in accordance with a further embodiment of the invention. The section is taken in a plane that is coplanar with the closing end of the slider.

Because the sliders of the assemblies disclosed herein are mounted inside the zipper, the bag film can be sealed directly to the exterior surfaces of the zipper bases without interfering with the operation of the slider. Thus, extension flanges below the zipper bases are not required. However, if required, flanges can be provided either above or below the bases or both. Being able to seal to the outside of the zipper halves makes it easier to incorporate header features that are typically used to provide evidence of tampering. One such package comprising a bag or receptacle 114 and a header 116 formed from a single folded web of bag film is shown in FIG. 9. The slider-zipper assembly is installed in the center fold of the web by hard seals 118 between the bag film and the exterior surfaces of the zipper bases. More specifically, opposing portions of a folded sheet of film are sealed to the exterior surfaces of the base strips of zipper parts 22*b* and 24*b*. The header 116 is formed by the fold in the web. This package is side sealed and then filled from the bottom. After filling, the bottom is sealed, for example, by forming a fin seal 120. Such a fin seal can also be formed on the side of the bag so that folds are formed at both the top and bottom of the bag; in such a case, the bag would be filled from the side. The slider-zipper assembly depicted in FIGS. 2 and 3 can be installed in a similarly constructed bag, i.e., in proximity to the center fold in the bag film.

Figure 10:
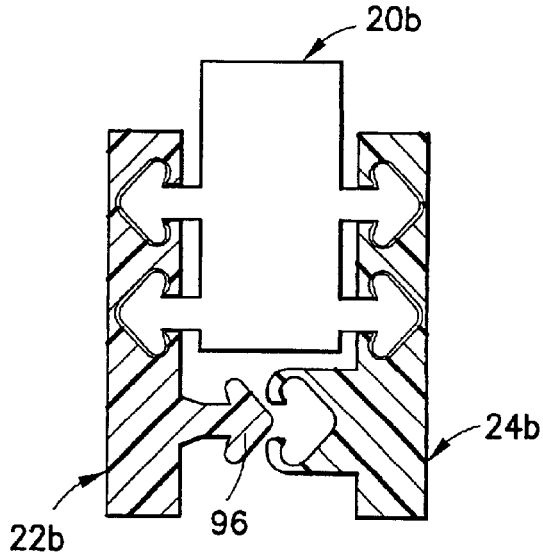
FIG. 10 is a schematic showing a sectional view (from the opposite end of the slider) of the slider-zipper assembly incorporated in the package depicted in FIG. 9. The section is taken in a plane that is coplanar with the opening end of the slider. Again, the positions of the male and female profiles have not been reversed for ease of comparison with FIG. 9.

To illustrate a further embodiment of a slider-zipper assembly, the package shown in FIG. 9 comprises a slider 20*b* that is the same as that seen in FIG. 7, except that each side has two ribs instead of one. More specifically, slider 20*b* has one pair of spaced mutually parallel ribs 110, 110' on one side and another pair of spaced mutually parallel ribs 112, 112' on the other side, each rib having a structure identical to ribs 110 and 112 shown in FIG. 7. A view of slider 20*b* from the opening end is presented in FIG. 10. To accommodate the two ribs on each side of slider 20*b*, the zipper part 22*b* has two longitudinal grooves 98, 98', while the zipper part 24*b* has two longitudinal grooves 106, 106', each groove being identical to grooves 98 and 106 depicted in FIG. 7.

Figure 11:
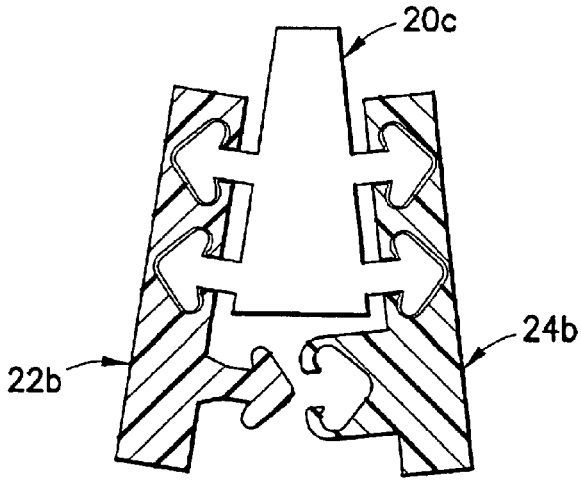
FIG. 11 is a schematic showing a sectional view of a slider-zipper assembly similar to that depicted in FIG. 10.

Although the slider embodiments depicted in FIGS. 7 and 9 have camming ribs that are linear, linearity is not necessary to practice of the invention. An example of a slider 20*c* having curved, i.e., nonlinear, ribs is shown in FIG. 11. At the closing end, the ribs of slider 20*c* would be oriented identically to ribs 110, 110' and 112, 112' seen in FIG. 9; in progressing from the closing end to the opening end of the slider, the tips of the ribs not only diverge, but also the ribs gradually change their direction, i.e., rotate about a horizontal axis, until they reach the orientations seen in FIG. 11. Thus, movement of slider 20*c* in the opening direction causes the zipper parts 22*b* and 24*b* to undertake both a translational and rotational movement that results in the closure elements separating as seen in FIG. 11. In contrast, in the embodiments previously described, the movements by the closure elements were substantially translational, without a rotational component by design.

Figure 12:
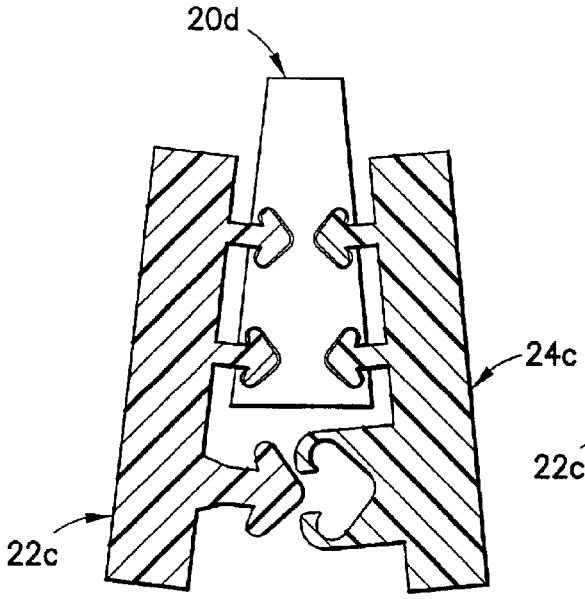
FIG. 12 is a schematic showing a sectional view of a slider-zipper assembly similar to that depicted in FIG. 11, except that the camming ribs project from the zipper bases instead of from the slider body and the grooves are formed in the slider body instead of in the zipper bases.

It will be obvious to persons skilled in the art that instead of forming the camming ribs on the slider and the matching grooves on the zipper bases, linear camming ribs can be formed on the zipper parts 22*c* and 24*c*, as shown in FIG. 12, while nonlinear grooves are formed in the sides of the slider 20*d*.

Figure 13:
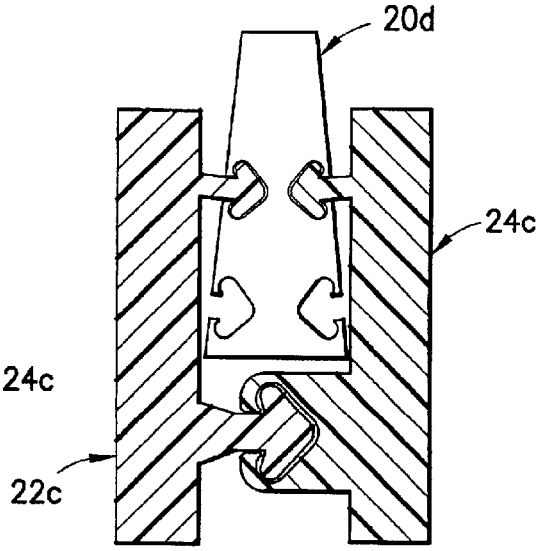
FIG. 13 is a schematic showing an end view of the assembly depicted in FIG. 12.

FIG. 13 shows a variation of the slider 20*d* depicted in FIG. 12. In FIG. 13, the closing end of slider 20*d* is shown positioned at the zipper fully closed position. To eliminate any gap in the closed zipper when the slider is in the fully closed position, the lower set of camming ribs on the zipper parts 22*c* and 24*c* are removed at the very edge of the bag mouth opening where the slider rests when in the fully closed position. The length of the removed rib section could be on the order of ½ the length of the slider, giving the wide opening end of the slider (visible in FIG. 13) nothing to push against, thereby allowing the zipper to remain closed at the very end. In the converse case where the ribs project from the slider and the grooves are formed in the zipper parts, a hole could be punched in each zipper part in the area of the lower groove so that the lower ribs on the slider have nothing to push against when the slider is in the fully closed position.

Figure 15:
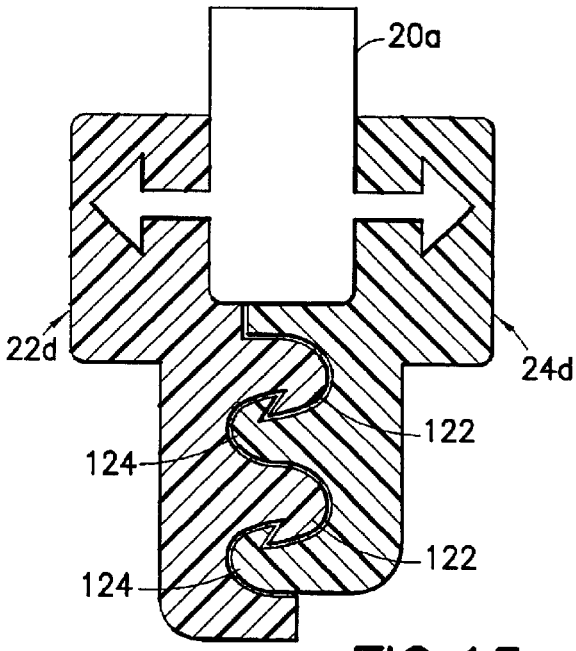
FIG. 15 is a schematic showing a sectional view of a slider-zipper assembly in accordance with an alternative embodiment.

As previously noted, the inside slider disclosed herein can also be used with zippers other than those having rib-and-groove closure elements. For example, as seen in FIG. 15, the zipper halves 22*d* and 24*d* may have respective sets 122, 124 of interlocking hooks. FIG. 15 shows the closing end of the slider 20*a*. The ribs projecting from the sides of slider 20*a* are divergent in a direction from the opening end to the closing end, so that the hooks 122 and 124 will be disengaged as the slider moves in the opening direction.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "projection" means a projection that is continuous or comprises a series of spaced-apart projecting sections. As used in the claims, the term "rib" means a structure comprising a stem and an enlarged head connected to an end of the stem, the enlarged head being of any shape, including but not limited to an arrow-head shape having two oppositely directed detents and a hook shape having a single detent on one side.

What is claimed is:

1. A package comprising:

front and rear walls;

a zipper comprising first and second zipper parts respectively joined to said front and rear walls, said first zipper part comprising a first base and a first closure element connected to said first base, and said second zipper part comprising a second base and a second closure element connected to said second base, said first and second closure elements being mutually engageable, said first base comprising an exterior surface facing away from said second base, and said second base comprising an exterior surface facing away from said first base, a portion of said front wall being joined to said exterior surface of said first base and a portion of said rear wall being joined to said exterior surface of said second base; and a slider mounted to said zipper and comprising a body having a first end where said zipper is open and a second end where said zipper is closed, a first direction being directed from said second end to said first end and a second direction being opposite to said first direction, and first and second camming surfaces that have respective fixed positional relationships to said body and are divergent in said first direction, said first and second camming surfaces being disposed so that said first and second zipper parts are respectively cammed toward each other by said first and second camming surfaces as said slider is moved in said first direction, wherein no part of said slider confronts said exterior surfaces of said first and second bases, and the portions of said first and second zipper parts that are in contact with said first and second camming surfaces respectively are displaced toward or away from each other along an axis generally perpendicular to said exterior surfaces of said first and second bases during travel of said slider along said zipper.

2. The package as recited in claim 1, further comprising a header, said front and rear walls and said header being formed from a single sheet of film that has been folded, said zipper being adjacent to the fold in said sheet.

3. The package as recited in claim 1, wherein said slider further comprises first and second ribs connected to said body, said first camming surface being part of said first rib and said second camming surface being part of said second rib, said first base of said first zipper part comprising a first groove in which said first rib is engaged, and said second base of said second zipper part comprising a second groove in which said second rib is engaged.

4. The package as recited in claim 1, wherein said slider further comprises first and second grooves formed in said body, said first camming surface being part of said first groove and said second camming surface being part of said second groove, said first zipper part further comprising a first rib connected to said first base and engaged with said first groove, and said second zipper part further comprising a second rib connected to said second base and engaged with said second groove.

5. The package as recited in claim 1, wherein said slider further comprises third and fourth camming surfaces that have respective fixed positional relationships to said body and are divergent in said first direction, said third and fourth camming surfaces being disposed so that said first and second zipper parts are respectively cammed away from each other by said third and fourth camming surfaces as said slider is moved in said second direction.

6. The package as recited in claim 5, wherein said slider further comprises first and second projections projecting from said body, said first and third camming surfaces being part of said first projection and said second and fourth camming surfaces being part of said second projection, said first camming surface abutting an interior surface of said first base, said second camming surface abutting an interior surface of said second base, said third camming surface abutting a shoulder on said first closure element, and said fourth camming surface abutting a shoulder on said second closure element.

7. The package as recited in claim 1, wherein said first closure element comprises a rib and said second closure element comprises a groove.

8. The package as recited in claim 1, wherein said first closure element comprises a plurality of hooks and said second closure element comprises a plurality of hooks, said hooks of said first closure element being interlockable with said hooks of said second closure element.

9. The package as recited in claim 1, wherein said slider further comprises first and second projections projecting from said body, said first camming surface being part of said first projection and said second camming surface being part of said second projection, said first camming surface abutting an interior surface of said first base and said second camming surface abutting an interior surface of said second base.

10. The package as recited in claim 1, wherein said body comprises a partition disposed between separated sections of said first and second closure elements.

11. The package as recited in claim 10, wherein said body further comprises an upper body part and a lower body part connected by said partition, said upper body part being located above said first and second closure elements, and said lower body part being located below said first and second closure elements.

12. The package as recited in claim 1, wherein said front wall is joined to said exterior surface of said first base and said rear wall is joined to said exterior surface of said second base.

13. The package as recited in claim 1, wherein said first base further comprises an interior surface facing said second base, said second base further comprises an interior surface facing said first base, and no part of said slider extends laterally beyond said interior surfaces of said first and second bases.

14. An assembly comprising first and second zipper parts and a slider mounted to said first and second zipper parts, said first and second zipper parts becoming mutually interlocked as said slider is moved along said second zipper part in a first direction and becoming mutually disengaged as said slider is moved along said second zipper part in a second direction opposite to said first direction, wherein:

said first zipper part comprises a first base and a first closure element connected to said first base, and said second zipper part comprises a second base and a second closure element connected to said second base, said first and second closure elements being mutually engageable, said first base comprising an exterior surface facing away from said second base, and said second base comprising an exterior surface facing away from said first base; and a slider mounted to said zipper and comprising a body having a first end where said zipper is open and a second end where said zipper is closed, first and second camming surfaces that have respective fixed positional relationships to said body and are divergent in said first direction, said first and second camming surfaces being disposed so that said first and second zipper parts are respectively cammed toward each other by said first and second camming surfaces as said slider is moved in said first direction, and third and fourth camming surfaces that have respective fixed positional relationships to said body and are divergent in said first direction, said third and fourth camming surfaces being disposed so that said first and second zipper parts are respectively cammed away from each other by said third and fourth camming surfaces as said slider is moved in said second direction.

15. The assembly as recited in claim 14, wherein said slider further comprises first and second ribs connected to said body, said first camming surface being part of said first rib and said second camming surface being part of said second rib, said first base of said first zipper part comprising a first groove in which said first rib is engaged, and said second base of said second zipper part comprising a second groove in which said second rib is engaged.

16. The assembly as recited in claim 14, wherein said slider further comprises first and second projections projecting from said body, said first camming surface being part of said first projection and said second camming surface being part of said second projection, said first camming surface abutting an interior surface of said first base and said second camming surface abutting an interior surface of said second base.

17. A slider for operating a flexible zipper, comprising a body having first and second ends and first and second sides, a first rib projecting outward from said first side of said body, a second rib projecting outward from said second side of said body, said first and second ribs being generally coplanar and non-parallel, a third rib projecting outward from said first side of said body and a fourth rib projecting outward from said second side of said body, wherein said first and third ribs are mutually parallel and said second and fourth ribs are mutually parallel.

18. A slider for operating a flexible zipper, comprising a body having first and second ends and first and second sides, a first groove formed in said first side of said body and opening on an exterior surface of said first side, and a second groove formed in said second side of said body and opening on an exterior surface of said second side, said first and second grooves being generally coplanar and non-parallel, a third groove formed in said first side of said body and opening on said exterior surface of said first side, and a fourth groove formed in said second side of said body and opening on said exterior surface of said second side, wherein said first and third grooves are mutually parallel and said second and fourth grooves are mutually parallel.

19. A package comprising first and second walls, a zipper comprising first and second zipper parts respectively joined to said first and second walls, and a slider mounted to said zipper, said first zipper part comprising a first base and a first closure element connected to said first base, said second zipper part comprising a second base and a second closure element connected to said second base and engageable with said first closure element, a portion of said front wall being joined to an exterior surface of said first base and a portion of said rear wall being joined to an exterior surface of said second base, said exterior surface of said first base facing away from said second base and said exterior surface of said second base facing away from said first base, said first base comprising a first groove that opens on an interior surface of said first base, said second base comprising a second groove that opens on an interior surface of said second base, and said slider comprising a body and first and second ribs connected to and projecting out of opposing sides of said body, said first and second ribs being not parallel with each other, said first rib being engaged in and slidable along said first groove, and said second rib being engaged in and slidable along said second groove, wherein the portions of said first and second grooves that are in contact with said first and second ribs respectively are displaced toward or away from each other along an axis generally perpendicular to said exterior surfaces of said first and second bases during travel of said slider along said zipper.

20. The package as recited in claim 19, wherein said first and second ribs diverge in a horizontal plane in a direction of slider movement that closes said zipper.

21. A package comprising a folded sheet of film sealed on three sides to form an enclosed receptacle, a zipper comprising first and second zipper parts sealed to first and second opposing portions of said sheet of film in proximity to the fold in said sheet, and a slider mounted to said zipper, said first zipper part comprising a first base strip having an exterior side sealed to said first opposing portion of said sheet of film and having a first closure element connected to and projecting from an interior side of said first base strip, said second zipper part comprising a second base strip having an exterior side sealed to said second opposing portion of said sheet of film and having a second closure element connected to and projecting from an interior side of said second base strip, and said second closure element being engageable with said first closure element when said slider is moved in one direction and being disengageable when said slider is moved in the opposite direction, one of said opposing portions of said folded sheet of film being joined to said exterior side of said first base strip and the other of said opposing portions of said folded sheet of film being joined to said exterior side of said second base strip, said exterior sides of said first base strip facing away from said second base strip and said exterior side of said second base strip facing away from said first base strip, wherein no part of said slider confronts either of said exterior surfaces of said first and second base strips and the portions of said first and second closure elements that are in contact with said slider are displaced toward or away from each other along an axis generally perpendicular to said exterior sides of said first and second base strips.

22. The package as recited in claim 21, wherein said slider rides on said first and second closure elements.

23. The package as recited in claim 21, wherein said slider comprises first and second grooves extending inward from opposing sides thereof, said first and second grooves being generally coplanar and non-parallel, said first zipper part further comprises a first rib connected to and projecting from said interior side of said first base strip, and said second zipper part further comprises a second rib connected to and projecting from said interior side of said second base strip, said first groove being engaged with a section of said first rib and said second groove being engaged with a section of said second rib.

24. The package as recited in claim 23, wherein said slider comprises third and fourth grooves extending inward from said opposing sides thereof, said third and fourth grooves being generally coplanar and non-parallel, said first zipper part further comprises a third rib connected to and projecting from said interior side of said first base strip, and said second zipper part further comprises a fourth rib connected to and projecting from said interior side of said second base strip, said third groove being engaged with a section of said third rib and said fourth groove being engaged with a section of said fourth rib, wherein said third and fourth ribs are absent from portions of said first and second zipper parts at one end of said zipper whereat said slider is parked when said zipper is fully closed.

25. The package as recited in claim 21, wherein said slider comprises first and second ribs projecting outward from opposing sides thereof, said first and second ribs being generally coplanar and non-parallel, said first zipper part further comprises a first groove that opens on said interior side of said first base strip, and said second zipper part further comprises a second groove that opens on said interior side of said second base strip, said first rib being engaged in a section of said first groove and said second rib being engaged in a section of said second groove.

26. A package comprising a receptacle with a zippered mouth and a slider mounted in said zippered mouth, wherein said zippered mouth comprises first and second ribs projecting inward from opposing sections of said zippered mouth, and said slider comprises a body having first and second ends and first and second sides, a first groove formed in said first side of said body and opening on an exterior surface of said first side, and a second groove formed in said second side of said body and opening on an exterior surface of said second side, said first and second grooves being generally coplanar and non-parallel, wherein said first groove engages said first rib and said second groove engages said second rib, wherein said zippered mouth further comprises a third rib projecting inward from one of said opposing sections and a third groove formed in the other of said opposing sections and opening on an interior surface of said other opposing section, said third rib being interlockable with said third groove by movement of said slider to close said zippered mouth.

27. A package comprising:

front and rear walls;

a zipper comprising first and second zipper parts respectively joined to said front and rear walls, said first zipper part comprising a first base and a first closure element connected to said first base, and said second zipper part comprising a second base and a second closure element connected to said second base, said first and second closure elements being mutually engageable, said first base comprising an exterior surface facing away from said second base and a first groove having an opening at an interior surface of said first base, and said second base comprising an exterior surface facing away from said first base and a second groove having an opening at an interior surface of said second base, a portion of said front wall being joined to said exterior surface of said first base and a portion of said rear wall being joined to said exterior surface of said second base; and a slider mounted to said zipper and comprising a body having a first end where said zipper is open and a second end where said zipper is closed, a first direction being directed from said second end to said first end and a second direction being opposite to said first direction, wherein said slider further comprises first and second ribs that project from opposing sides of said body and are not parallel with each other, said first base comprises a first groove in which said first rib is engaged, and said second base comprises a second groove in which said second rib is engaged.

28. A package comprising:

front and rear walls;

a zipper comprising first and second zipper parts respectively joined to said front and rear walls, said first zipper part comprising a first base and a first closure element connected to said first base, and said second zipper part comprising a second base and a second closure element connected to said second base, said first and second closure elements being mutually engageable, said first base comprising an exterior surface facing away from said second base and a first groove having an opening at an interior surface of said first base, and said second base comprising an exterior surface facing away from said first base and a second groove having an opening at an interior surface of said second base, a portion of said front wall being joined to said exterior surface of said first base and a portion of said rear wall being joined to said exterior surface of said second base; and a slider mounted to said zipper and comprising a body having a first end where said zipper is open and a second end where said zipper is closed, a first direction being directed from said second end to said first end and a second direction being opposite to said first direction, wherein said slider further comprises first and second grooves that open on opposing sides of said body and are not parallel with each other, said first base comprises a first rib which is engaged by said first groove, and said second base comprises a second rib which is engaged by said second groove.

* * * * *